US007212171B2

(12) United States Patent
Lee

(10) Patent No.: US 7,212,171 B2
(45) Date of Patent: May 1, 2007

(54) DIPOLE ANTENNA

(75) Inventor: Chang-Jung Lee, Taoyuan County (TW)

(73) Assignee: Arcadyan Technology Corporation, Hsinchu (TW)

( * ) Notice: Subject to any disclaimer, the term of this patent is extended or adjusted under 35 U.S.C. 154(b) by 66 days.

(21) Appl. No.: 11/209,811

(22) Filed: Aug. 24, 2005

(65) Prior Publication Data

US 2007/0052611 A1 Mar. 8, 2007

(51) Int. Cl.
*H01Q 9/28* (2006.01)

(52) U.S. Cl. ..... 343/795; 343/700 MS

(58) Field of Classification Search ..... 343/700 MS, 343/795

See application file for complete search history.

(56) References Cited

U.S. PATENT DOCUMENTS 6,424,311 B1 * 7/2002 Tsai et al. ..... 343/795
6,529,170 B1 * 3/2003 Nishizawa et al. ..... 343/795
7,012,573 B2 * 3/2006 Tchistiakov et al. ..... 343/795
2006/0038735 A1 * 2/2006 Shtrom et al. ..... 343/795
2006/0238433 A1 * 10/2006 Chou ..... 343/795

* cited by examiner

*Primary Examiner*—Tan Ho
(74) *Attorney, Agent, or Firm*—Birch, Stewart, Kolasch & Birch, LLP

(57) ABSTRACT

A dipole antenna includes a substrate, a first radiating member and a second radiating member. The substrate has a first surface and a second surface opposite to the first surface. The first radiating member and the second radiating member are symmetrically disposed on the first surface and the second surface of the substrate, and electrically connected to a grounding point and a feeding point, respectively. The first radiating member has a first radiating part, a second radiating part and a third radiating part, which are respectively disposed on the first surface and the second surface of the substrate and electrically connected to one another. The second radiating member has a fourth radiating part, a fifth radiating part and a sixth radiating part, which are respectively disposed on the first surface and the second surface of the substrate and are electrically connected to one another.

18 Claims, 6 Drawing Sheets

Frequency : 2450 MHz
Peak Gain : -2.57dBi(@113°)
Average Gain : -6.71dBi

Frequency : 2450 MHz
Peak Gain : -0.33dBi(@352°)
Average Gain : -4.17dBi

Frequency : 2450 MHz
Peak Gain : 0.09dBi (@176°)
Average Gain : -0.95dBi

DIPOLE ANTENNA

BACKGROUND OF THE INVENTION

1. Field of Invention

The invention relates to an antenna, and more particularly to a dipole antenna with an effectively reduced dimension.

2. Related Art

The rapidly developed radio transmission has brought various products and technologies applied in the field of multi-band transmission, such that many new products have the performance of radio transmission to meet the consumer's requirement. The antenna is an important element for transmitting and receiving electromagnetic wave energy in the radio transmission system. If the antenna is lost, the radio transmission system cannot transmit and receive data. Thus, the antenna plays an indispensable role in the radio transmission system. Selecting a proper antenna can match the feature of the product, enhance the transmission property, and further reduce the product cost. Different methods and different materials for manufacturing the antennas are used in different application products. In addition, considerations have to be taken when the antenna is designed according to different frequency bands used in different countries. The commonly used specifications of frequency band include IEEE 802.11, the most popular bluetooth communication (IEEE 802.15.1), and the like. The bluetooth works at the frequency band of 2.4 GHz. IEEE 802.11 is further divided into 802.11a, 802.11b and 802.11g, wherein the 802.11a specification corresponds to the frequency band of 5 GHz, and the 802.11b and 802.11g specifications correspond to the frequency band of 2.4 GHz.

The most-frequently used antennas in the industry include a monopole antenna, an inverted-F antenna, and a dipole antenna. Because the dipole antenna can effectively radiate and receive the electromagnetic wave, it is widely used in various communication fields. However, if the conventional dipole antenna wants to reach the better polarization effect, its dimension cannot be effectively reduced, and the product dimension has to be increased and cannot meet the miniaturization trend of the current electrical device.

Therefore, it is an important subject of the invention to design a dipole antenna with an effectively reduced dimension such that the product can be minimized.

SUMMARY OF THE INVENTION

In view of the foregoing, the invention is to provide a dipole antenna with an effectively reduced dimension so that the product can be minimized.

To achieve the above, a dipole antenna of the invention includes a substrate, a first radiating member and a second radiating member. The first radiating member and the second radiating member are disposed symmetrically. In this invention, the substrate has a first surface and a second surface opposite to the first surface. The first radiating member has a first radiating part, a second radiating part and a third radiating part. The first radiating part is disposed on the first surface and electrically connected to a grounding point. The second radiating part is disposed on the first surface. The third radiating part is disposed on the second surface and electrically connected to the first radiating part and the second radiating part. The second radiating member has a fourth radiating part, a fifth radiating part and a sixth radiating part. The fourth radiating part is disposed on the second surface and electrically connected to a feeding point. The fifth radiating part is disposed on the second surface.

The sixth radiating part is disposed on the first surface and electrically connected to the fourth radiating part and the fifth radiating part.

As mentioned above, the third radiating part of the first radiating member and the first and second radiating parts of the first radiating member are on opposite surfaces, and the sixth radiating part of the second radiating member and the fourth and fifth radiating parts of the second radiating member are disposed on opposite surfaces. Thus, it is possible to effectively reduce the dimension of the dipole antenna, such that the application product of the dipole antenna may be minimized, and the trend of miniaturized electrical devices can be met.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
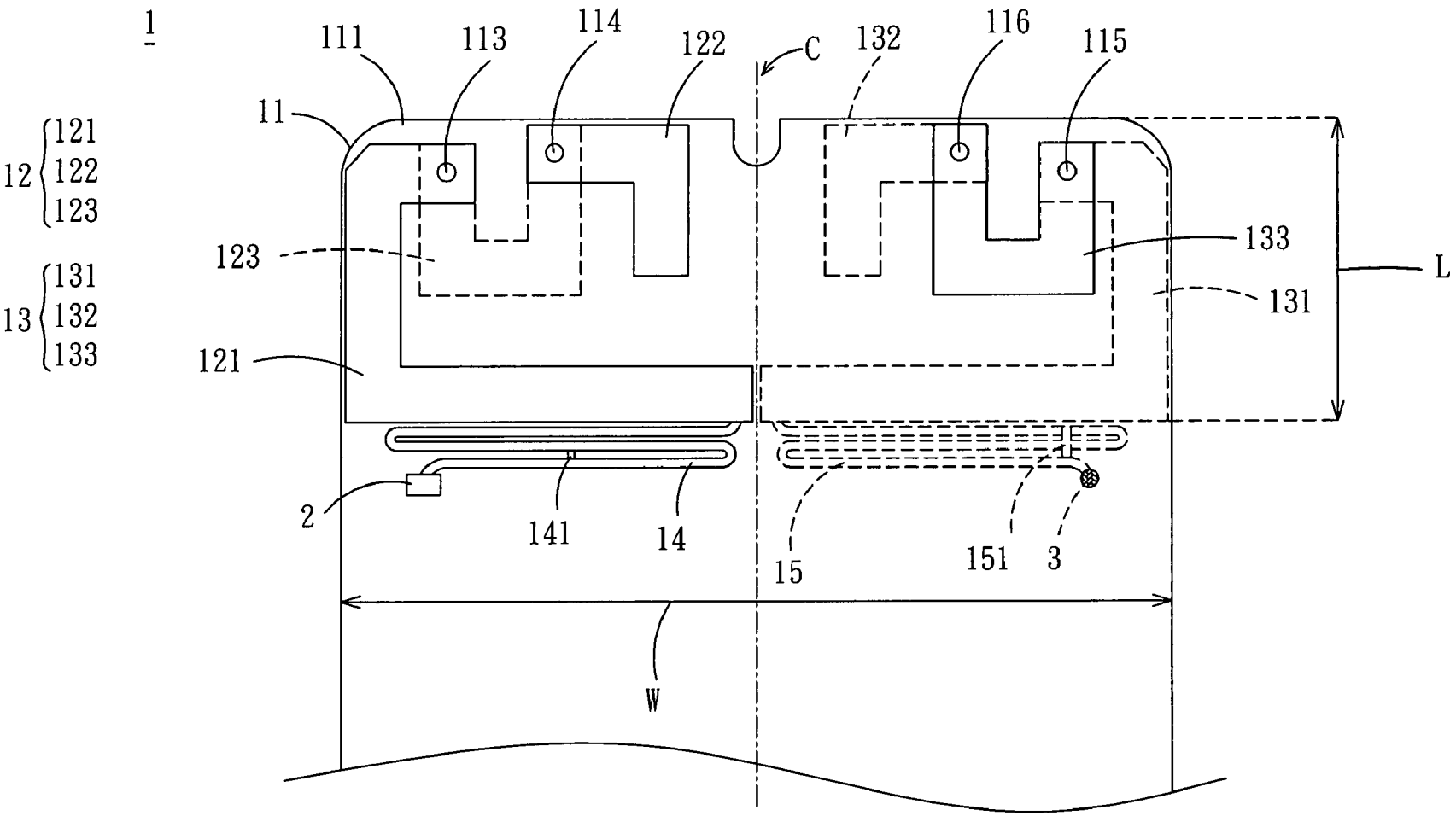
FIG. 1 is a side view showing a dipole antenna according to a preferred embodiment of the invention.
Figure 2:
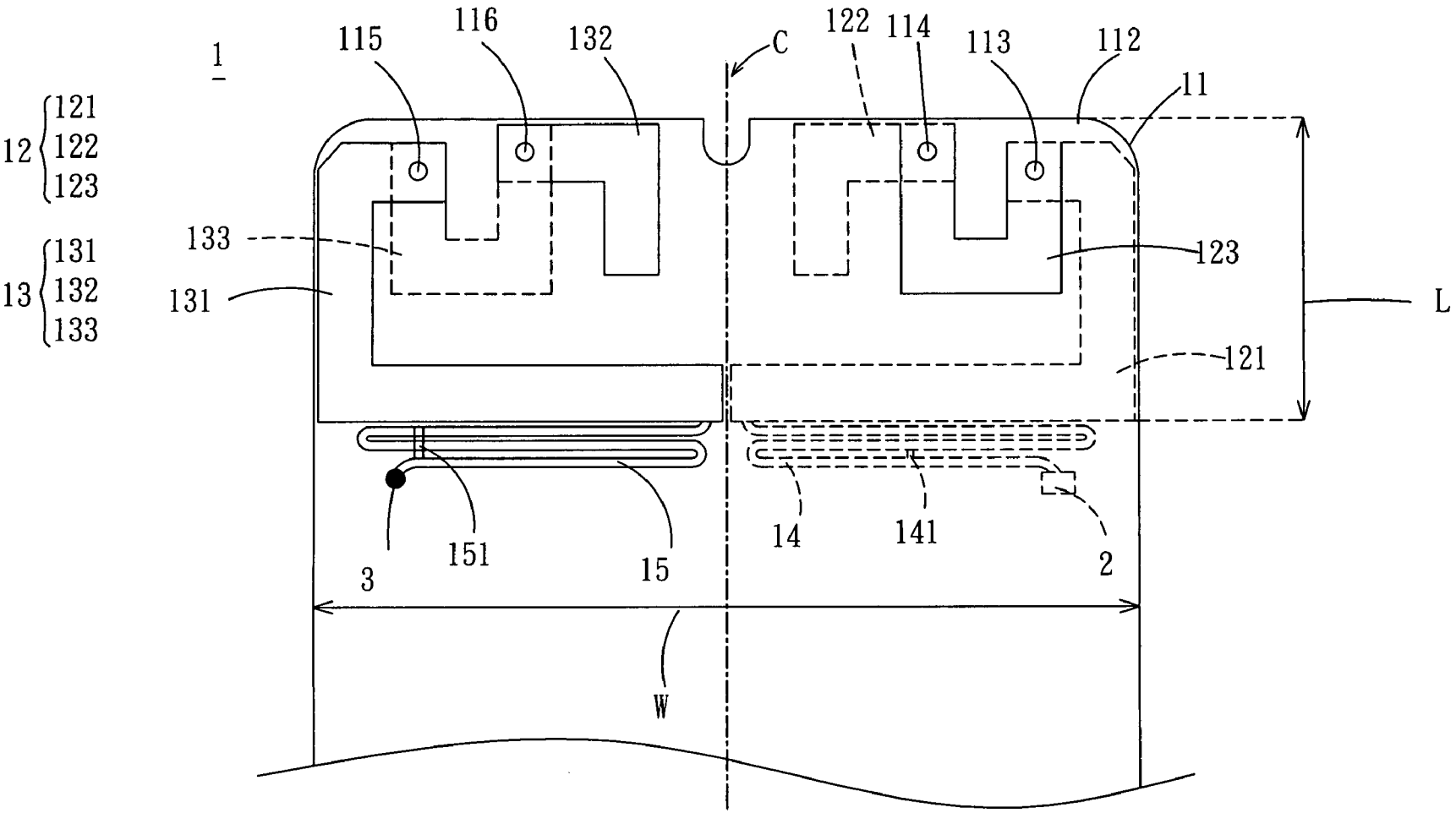
FIG. 2 is another side view showing the dipole antenna according to the preferred embodiment of the invention.

Referring to FIGS. 1 and 2, a dipole antenna 1 according to the preferred embodiment of the invention includes a substrate 11, a first radiating member 12 and a second radiating member 13. The first radiating member 12 and the second radiating member 13 are symmetrically disposed on the substrate 11 with a center axis C serving as a symmetrical axis. The dipole antenna 1 may have a length L ranging from about 0.6 cm to 0.9 cm, and a width W ranging from about 1.5 cm to 2.3 cm.

The substrate 11 has a first surface 111, a second surface 112, a first through hole 113, a second through hole 114, a third through hole 115 and a fourth through hole 116. The first surface 111 and the second surface 112 are opposite to each other. In this embodiment, the material of the substrate 11 may be a printed circuit board made of a Bismaleimide-triazine (BT) resin or a fiberglass reinforced epoxy resin (FR4). Alternatively, the substrate 11 may be a flexible film substrate made of polyimide. Moreover, it may be integrated in one part of the circuit layout of an electronic device so that the occupied space may be reduced.

The first radiating member 12 has a first radiating part 121, a second radiating part 122 and a third radiating part 123. The first radiating part 121 is disposed on the first surface 111 and connected to the first through hole 113. In addition, the first radiating part 121 is also electrically connected to a grounding point 2. The second radiating part 122 is disposed on the first surface 111 and connected to the second through hole 114. The third radiating part 123 is disposed on the second surface 112 and electrically connected to the first radiating part 121 and the second radiating part 122 through the first through hole 113 and the second through hole 114, respectively.

The second radiating member 13 has a fourth radiating part 131, a fifth radiating part 132 and a sixth radiating part 133. The fourth radiating part 131 is disposed on the second surface 112 and connected to the third through hole 115. The fifth radiating part 132 is disposed on the second surface 112 and electrically connected to the fourth through hole 116. In addition, the fourth radiating part 131 may also be electrically connected to a feeding point 3. The sixth radiating part 133 is disposed on the first surface 111 and electrically connected to the fourth radiating part 131 and the fifth radiating part 132 through the third through hole 115 and the fourth through hole 116, respectively.

In this embodiment, the first to third radiating parts 121 to 123, and the fourth to sixth radiating parts 131 to 133 may be disposed symmetrically.

In addition, the first radiating part 121 and the fourth radiating part 131 may be configured to have an L-shape, the second radiating part 122 and the fifth radiating part 132 may be configured to have an L-shape, the third radiating part 123 and the sixth radiating part 133 may be configured to have a U-shape, as shown in FIGS. 1 and 2, according to different requirements in this embodiment.

Furthermore, an electroconductive material or electroconductive materials may be formed in the first through hole 113, the second through hole 114, the third through hole 115 and the fourth through hole 116 according to the actual requirement in this embodiment. Accordingly, the third radiating part 123 is electrically connected to the first radiating part 121 and the second radiating part 122 through the first through hole 113 and the second through hole 114 with the electroconductive material(s), respectively, and the sixth radiating part 133 is electrically connected to the fourth radiating part 131 and the fifth radiating part 132 through the third through hole 115 and the fourth through hole 116 with the electroconductive material(s), respectively.

In addition, the dipole antenna 1 may further include a first impedance matching unit 14 disposed on the first surface 111 of the substrate 11 and a second impedance matching unit 15 disposed on the second surface 112 of the substrate 11.

In this embodiment, the first radiating part 121 is electrically connected to the grounding point 2 through the first impedance matching unit 14, and the fourth radiating part 131 is electrically connected to the feeding point 3 through the second impedance matching unit 15. In addition, the first impedance matching unit 14 and the second impedance matching unit 15 may be configured to have a continuously curved shape according to the actual requirements such as for saving the space.

Furthermore, it is also possible to add a first short-circuit member 141 to the first impedance matching unit 14 and a second short-circuit member 151 to the second impedance matching unit 15 according to the experimental or simulated result, such that the dipole antenna 1 may be adjusted to have a better impedance matching condition. In this embodiment, in order to make the dipole antenna 1 operate at the frequency band of about 2.4 GHz and have the better impedance matching effect, the first short-circuit member 141 and the second short-circuit member 151 are disposed as shown in FIG. 1.

Figure 3:
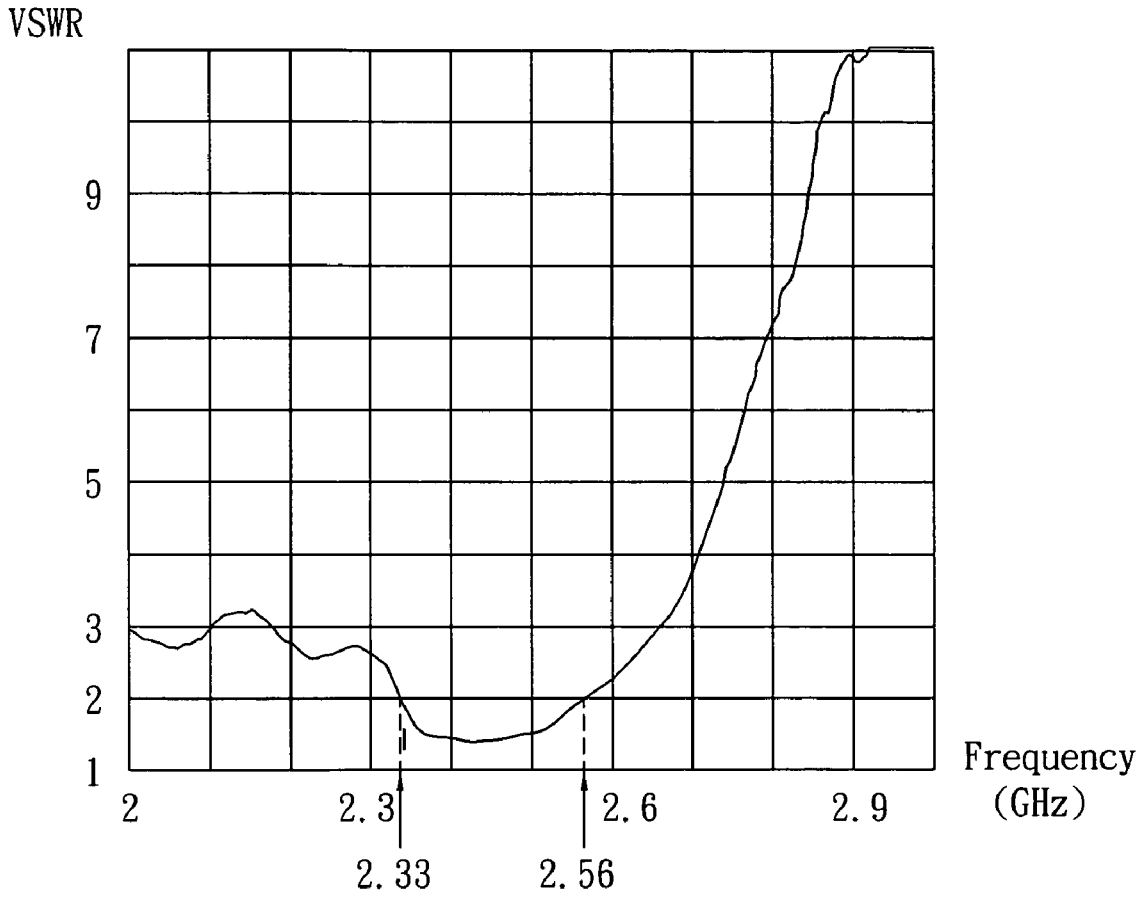
FIG. 3 is a schematic illustration showing a measured result of a voltage standing wave ratio of the dipole antenna according to the embodiment of the invention.

As shown in FIG. 3, the vertical axis represents the static voltage standing wave ratio (VSWR), and the horizontal axis represents the frequency. According to the definition of the VSWR smaller than 2, it can be observed that the dipole antenna 1 according to the preferred embodiment of the invention can operate at the frequency band ranging from about 2.33 GHz to 2.56 GHz.

Figure 4:
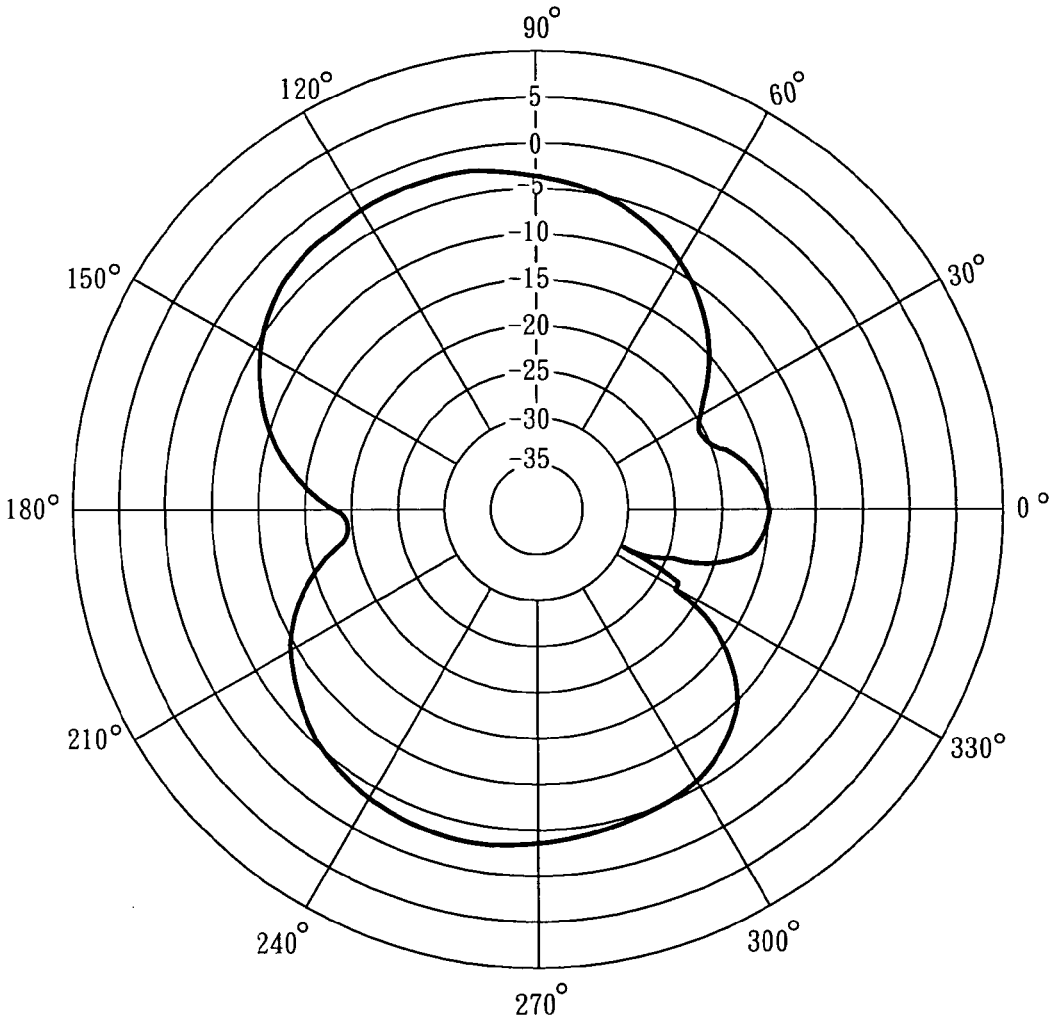
FIG. 4 is a schematic illustration showing a measured result of a radiation pattern on an E-Plane when the dipole antenna of this embodiment is operating at 2.45 GHz.
Figure 5:
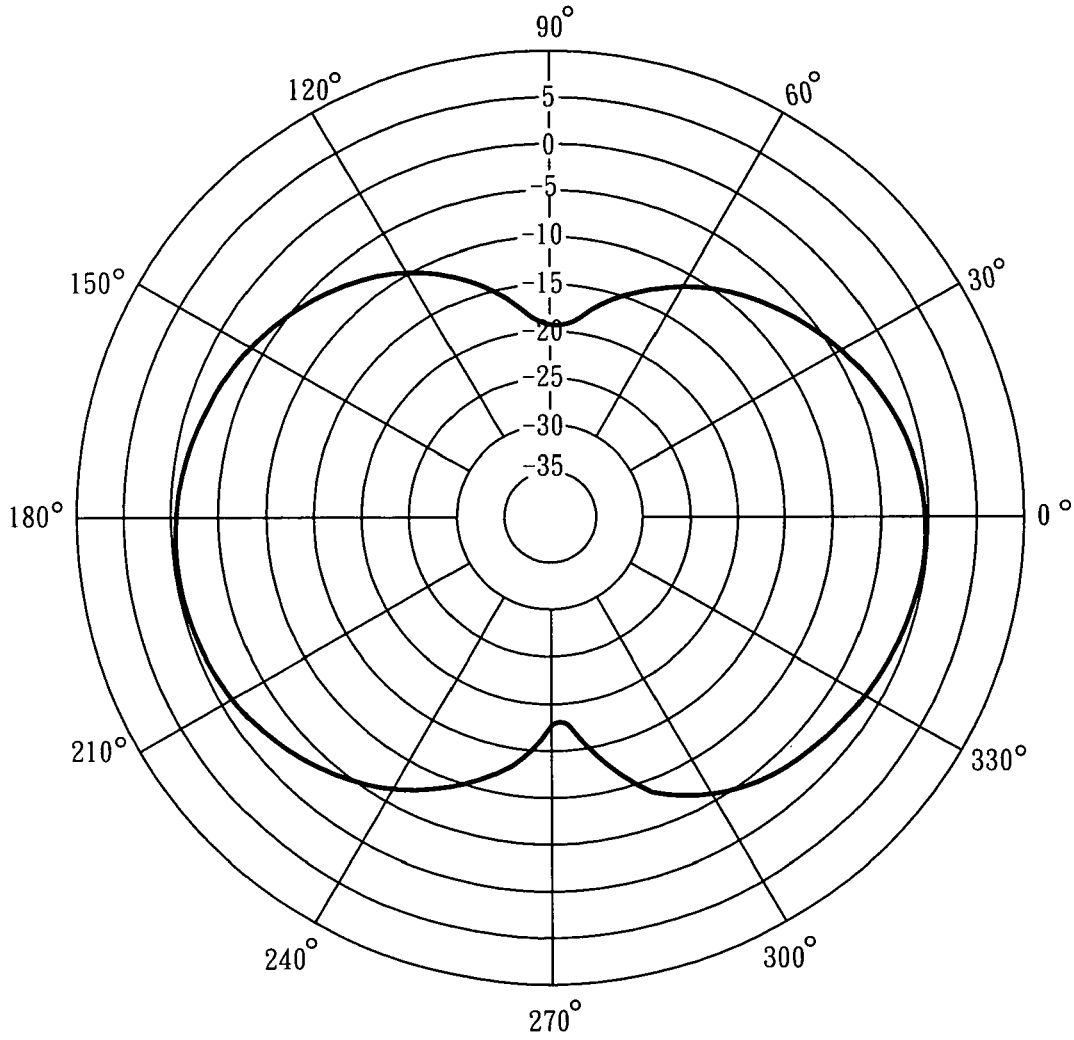
FIG. 5 is a schematic illustration showing another measured result of the radiation pattern on an E-Plane when the dipole antenna of this embodiment is operating at 2.45 GHz.
Figure 6:
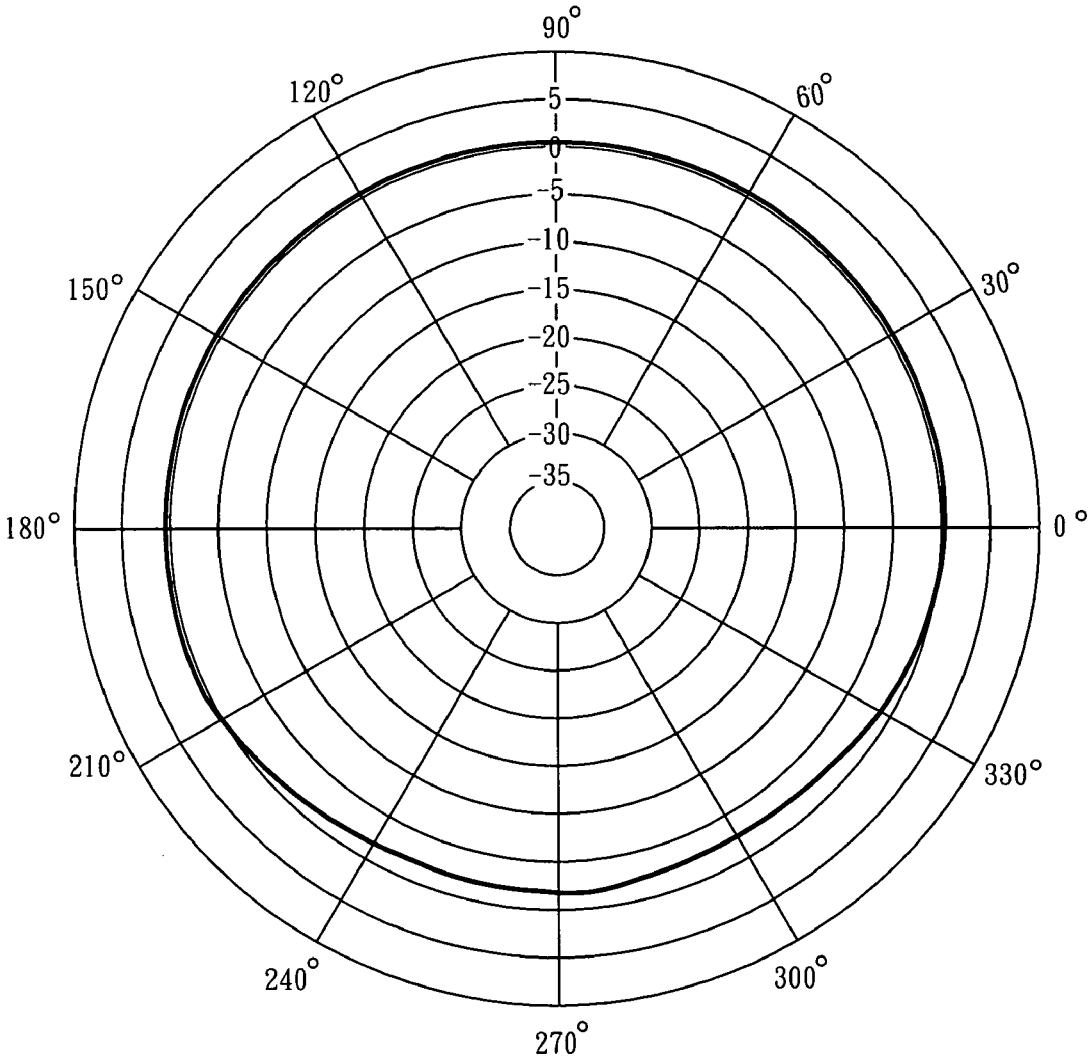
FIG. 6 is a schematic illustration showing a measured result of the radiation pattern on an H-Plane when the dipole antenna of this embodiment is operating at 2.45 GHz.

FIGS. 4 to 6 show measured results of a radiation pattern on an E-Plane and an H-Plane when the dipole antenna of this embodiment is operating at 2.45 GHz. It is observed that the polarization effect of the dipole antenna 1 of the invention is not worse than the prior art dipole antenna and can meet the commercial standard.

In summary, the third radiating part of the first radiating member and the first and second radiating parts of the first radiating member are on opposite surfaces and the third radiating part is electrically connected to the first and second radiating parts through the first and second through holes, respectively, in the dipole antenna of the invention. In addition, the sixth radiating part of the second radiating member and the fourth and fifth radiating parts of the second radiating member are disposed on opposite surfaces, and the sixth radiating part is electrically connected to the fourth and fifth radiating parts through the third and fourth through holes, respectively. Thus, it is possible to effectively reduce the dimension of the dipole antenna, and the power gain and bandwidth may be increased such that the application product of the dipole antenna may be minimized, and the trend of miniaturized electrical devices can be met.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A dipole antenna, comprising:

a substrate, which has a first surface and a second surface opposite to the first surface;

a first radiating member, which comprises a first radiating part disposed on the first surface and electrically connected to a grounding point, a second radiating part disposed on the first surface, and a third radiating part disposed on the second surface and electrically connected to the first radiating part and the second radiating part; and a second radiating member, which is symmetrically disposed with the first radiating member and comprises a fourth radiating part disposed on the second surface and electrically connected to a feeding point, a fifth radiating part disposed on the second surface, and a sixth radiating part disposed on the first surface and electrically connected to the fourth radiating part and the fifth radiating part.

2. The dipole antenna according to claim 1, wherein the first radiating part and the fourth radiating part are disposed symmetrically.

3. The dipole antenna according to claim 1, wherein the second radiating part and the fifth radiating part are disposed symmetrically.

4. The dipole antenna according to claim 1, wherein the third radiating part and the sixth radiating part are disposed symmetrically.

5. The dipole antenna according to claim 1, wherein each of the first radiating part and the fourth radiating part is L-shaped.

6. The dipole antenna according to claim 1, wherein each of the second radiating part and the fifth radiating part is L-shaped.

7. The dipole antenna according to claim 1, wherein each of the third radiating part and the sixth radiating part is U-shaped.

8. The dipole antenna according to claim 1, further comprising:

a first impedance matching unit, which is disposed on the first surface of the substrate and electrically connected to the first radiating part.

9. The dipole antenna according to claim 8, wherein the first impedance matching unit has a continuously curved shape.

10. The dipole antenna according to claim 8, wherein the first impedance matching unit has a first short-circuit member.

11. The dipole antenna according to claim 8, wherein the first radiating part is electrically connected to the grounding point through the first impedance matching unit.

12. The dipole antenna according to claim 1, further comprising:

a second impedance matching unit, which is disposed on the second surface of the substrate and electrically connected to the fourth radiating part.

13. The dipole antenna according to claim 12, wherein the second impedance matching unit has a continuously curved shape.

14. The dipole antenna according to claim 12, wherein the second impedance matching unit has a second short-circuit member.

15. The dipole antenna according to claim 12, wherein the fourth radiating part is electrically connected to the feeding point through the second impedance matching unit.

16. The dipole antenna according to claim 1, wherein the substrate further comprises a first through hole, a second through hole, a third through hole and a fourth through hole, the third radiating part is electrically connected to the first radiating part and the second radiating part through the first through hole and the second through hole, respectively, and the sixth radiating part is electrically connected to the fourth radiating part and the fifth radiating part through the third through hole and the fourth through hole, respectively.

17. The dipole antenna according to claim 16, wherein an electroconductive material is formed in the first through hole, the second through hole, the third through hole and the fourth through hole.

18. The dipole antenna according to claim 1, wherein the dipole antenna operates at a frequency band of about 2.4 GHz.

* * * * *